United States Patent [19]

Young

[11] 4,090,182

[45] May 16, 1978

[54] SECURITY SYSTEM EMPLOYING RADIO TRANSMITTER AND RECEIVER

[76] Inventor: Robert Bruno Young, 3 Dorset Way, Glen Cove, N.Y. 11542

[21] Appl. No.: 669,277

[22] Filed: Mar. 22, 1976

[51] Int. Cl.[2] ..... G08B 13/08

[52] U.S. Cl. ..... 340/274 R; 340/224; 343/225

[58] Field of Search ..... 340/224, 274 R, 256; 343/225

[56] References Cited

U.S. PATENT DOCUMENTS

| | | | |
|---|---|---|---|
| 3,588,866 | 6/1971 | Schlafly, Jr. | 340/274 R |
| 3,757,319 | 9/1973 | Hedin | 340/274 |
| 3,833,895 | 9/1974 | Fecteau | 340/224 |
| 3,891,980 | 6/1975 | Lewis et al. | 343/225 |

*Primary Examiner*—Glen R. Swann, III
*Attorney, Agent, or Firm*—Brumbaugh, Graves, Donohue & Raymond

[57] ABSTRACT

A security system gives an alarm when unauthorized persons gain access to a protected space by opening a door or window, etc., but permits access by authorized persons without giving an alarm. The alarm is given automatically when the door or window, etc., is opened, unless the alarm is silenced by operation of a concealable portable transmitter, intended to be carried by authorized persons. The transmitter when actuated transmits a control signal, which may be coded, to a receiver-driver, which then completes a shunt circuit around the door or window, etc., so that the latter can be opened without setting off the alarm.

In one embodiment of the invention, in which the receiver-driver depends upon house current for its operation, an alternative means of silencing the alarm is provided. If the house current fails, thereby rendering the receiver-driver inoperative, a second shunt circuit around the door or window, etc., is automatically armed, and the second shunt circuit can then be completed by manual operation of a lock-actuated switch. The key necessary to operate the lock is issued only to authorized persons.

7 Claims, 2 Drawing Figures

SECURITY SYSTEM EMPLOYING RADIO TRANSMITTER AND RECEIVER

BACKGROUND OF THE INVENTION

This invention relates to security systems and, more particularly, to a novel and highly-effective security system which reliably gives an alarm when unauthorized persons gain access to a protected space by opening a door or window, etc., but which permits access to the protected space by authorized persons without giving an alarm.

Security systems which will give an alarm upon unauthorized entry into a protected space but which will permit authorized entry into the protected space without giving an alarm are known. Typically, however, persons making authorized entry into the protected space must take some obvious action in order to silence the alarm, such as throwing a wall-mounted switch or using a special key. Such a system suffers from the disadvantage, among others, that its existence is in effect advertised for all to see. This may put burglars or others intent upon unauthorized entry on notice that the space in question is protected by an alarm system and that countermeasures will be necessary. The burglar or other intruder makes a systematic search for the contacts that become separated when the door or window, etc., is opened and, in some cases, is able to circumvent the system by the simple expedient of placing a shunt around these contacts.

SUMMARY OF THE INVENTION

An object of the invention is to remedy the problem described above and, more particularly, to provide a security system which reliably gives an alarm when unauthorized persons gain access to a protected space by opening a door or window, etc., which permits access to the protected space by authorized persons without giving an alarm, and which is of such design that its presence need not be advertised when authorized persons enter and leave the protected space.

Another object of the invention is to provide a security system that is adapted primarily, but not exclusively, for use in a typical small city apartment, especially for protection of the door or doors against entry by burglars.

Among the other objects of the invention are to provide a security system which:

Utilizes simple, conventional components that are inexpensive and readily available;

Can be operated without the use of a special lock and key, at least when the system is functioning normally;

Incorporates simple means by which it is possible to determine that the system is operative;

Is readily adapted for use by different households in the same apartment building without interference with one another in terms of setting off an alarm and is of such construction that entry into one protected area by authorized persons does not provide an opportunity for entry into another protected area by unauthorized persons;

Provides constant protection without the need to take continuous or repeated affirmative action to maintain the system in operation;

Allows a flexible and unlimited period of time for authorized entry into a protected space without the risk of setting off an alarm unintentionally;

Permits selective protection of certain points of entry by means of a special code;

Is of such construction that an attempt to circumvent it will cause an alarm to be set off;

Is of such construction that there is minimum likelihood of a false alarm; and

Is also adapted for use on mobile property, such as cars and trailers.

The foregoing and other objects are attained in accordance with the invention by providing a security system comprising circuit means operatively associated with openable means such as a door or window, voltage means for applying a voltage to the circuit means, and alarm means operatively associated with the circuit means for giving an alarm in response to a given condition of the circuit means. First switch means is provided in the circuit means the condition of which changes when the openable means is opened, transmitter means is provided controllable by authorized persons for transmitting a control signal, and receiver-driver means is provided for receiving the control signal. Second switch means is provided in the circuit means the position of which is controllable by the receiver-driver means in response to reception of the control signal so long as the receiver-driver means is operative. The condition of the second switch means when the openable means is open then determines the condition of the circuit means and hence whether the alarm means is actuated.

The first and second switch means preferably comprise first and second make-break switches, respectively, in parallel with each other. The first switch is closed when the openable means is closed and open when the openable means is open, and the second switch is normally open and is closed by the receiver-driver means in response to reception by the receiver-driver means of the control signal. The alarm is given when both of the switches are open.

In one embodiment of the invention, the receiver-driver means comprises self-contained battery means by which it is powered. In another embodiment, the receiver-driver means is powered by house current. In the latter case, third switch means is provided in the circuit means the condition of which is controlled by the presence or absence of the house current, and lock-actuated switch means is provided in the circuit means the condition of which is controllable by authorized persons. When the house current fails, thereby rendering the receiver-driver means inoperative, the conditions of the third and lock-actuated switch means determine the condition of the circuit means when the openable means is open and hence whether the alarm means is actuated.

In the case where the first and second switch means comprise first and second make-break switches, respectively, in parallel with each other, the first switch being closed when the openable means is closed and open when the openable means is open and the second switch being normally open and being closed by the receiver-driver means in response to reception by the receiver-driver means of the control signal, the third and lock-actuated switch means preferably comprise third and lock-actuated make-break switches, respectively, in series with each other and collectively in parallel with the first and second switches. The third switch is then open when the house current is present and closed when the house current is absent, and the lock-actuated switch is normally open and is closable by authorized persons. The alarm is then given when and only when the first and second switches and at least one of the third and lock-actuated switches are open.

The transmitter means is preferably a portable unit concealable on the person.

The control signal transmitted by the transmitter means may be coded to reduce the likelihood of a false response by the receiver-driver means to spurious signals.

BRIEF DESCRIPTION OF THE DRAWING

The invention may be better understood by reference to the following detailed description of the preferred embodiments thereof, in conjunction with the appended figures of the drawing, wherein.

DESCRIPTION OF THE PREFERRED EMBODIMENTS

Figure 1:
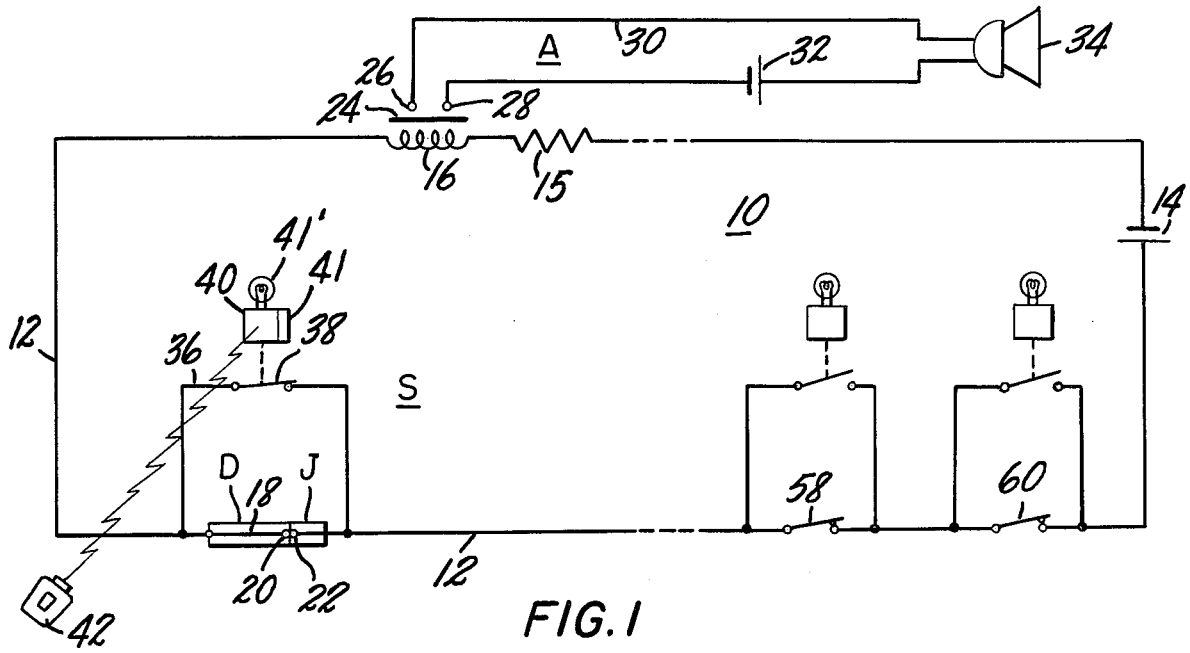
FIG. 1 is a schematic diagram of a preferred embodiment of the invention.

FIG. 1 shows a system for giving an alarm when unauthorized persons gain access to a protected space S by opening openable means such as a door or window D and for permitting access to the protected space by authorized persons without giving an alarm. The system comprises circuit means 10 including a wire loop 12, voltage means such as a battery 14 for applying a voltage thereto, a current-limiting resistor 15 and a relay coil 16. The wire loop 14 runs through the door D and forms the movable arm of a first switch 18 on which is arranged a contact 20 adapted to close with a contact 22 on the doorjamb J. As long as the door D is closed, the contacts 20 and 22 are engaged, the circuit is completed, and the battery 14 sends a current through the coil 16, which then holds contact arm 24 away from the contacts 26, 28 of a circuit 30 of alarm means A. A battery 32 in the circuit 30 powers a horn, siren or other alarm 34 when the circuit 30 is closed by movement of the contact arm 24 into engagement with the contacts 26, 28 to complete that circuit. The alarm 34 can be mounted locally, in which case the intruder is likely to hear it and be frightened off, or it can be mounted at a remote location such as a police station, in which case there may be a greater likelihood of apprehending the intruder. In one embodiment of the invention (not illustrated) the circuit 30 when completed actuates an automatic telephone dialer for automatically dialing the police using the telephone system and for transmitting a recorded message.

Accordingly, if a burglar or other unauthorized person opens the door 18, the desired kind of alarm will be set off.

Authorized persons may enter and leave the protected space S without setting off an alarm by completing a shunt circuit 36 around the door D. This shunt circuit 36 is normally open and is closed by a second switch 38 which is in parallel in the circuit 10 with the first switch 18 and actuated by a small radio-controlled receiver-driver 40. The receiver-driver 40 responds only to a proper signal from a concealable portable transmitter 42, intended to be carried by authorized persons such as the residents of an apartment or a security guard or watchman. The transmitter 42 and receiver-driver 40 may simply be tuned to the same frequency, or a more elaborate coding may be employed to make it virtually impossible for a burglar or other would-be intruder equipped with a transmitter to trigger the receiver-driver 40 into closing the switch 38. For example, several transmission frequencies may be employed simultaneously or in some specified sequence, or the length and number of transmitted pulses may have to conform to a predetermined code in order to activate the receiver-driver 40 to close the switch 38.

The receiver-driver 40 may operate on batteries as indicated at 41 (FIG. 1), in which case it is self-contained.

Figure 2:
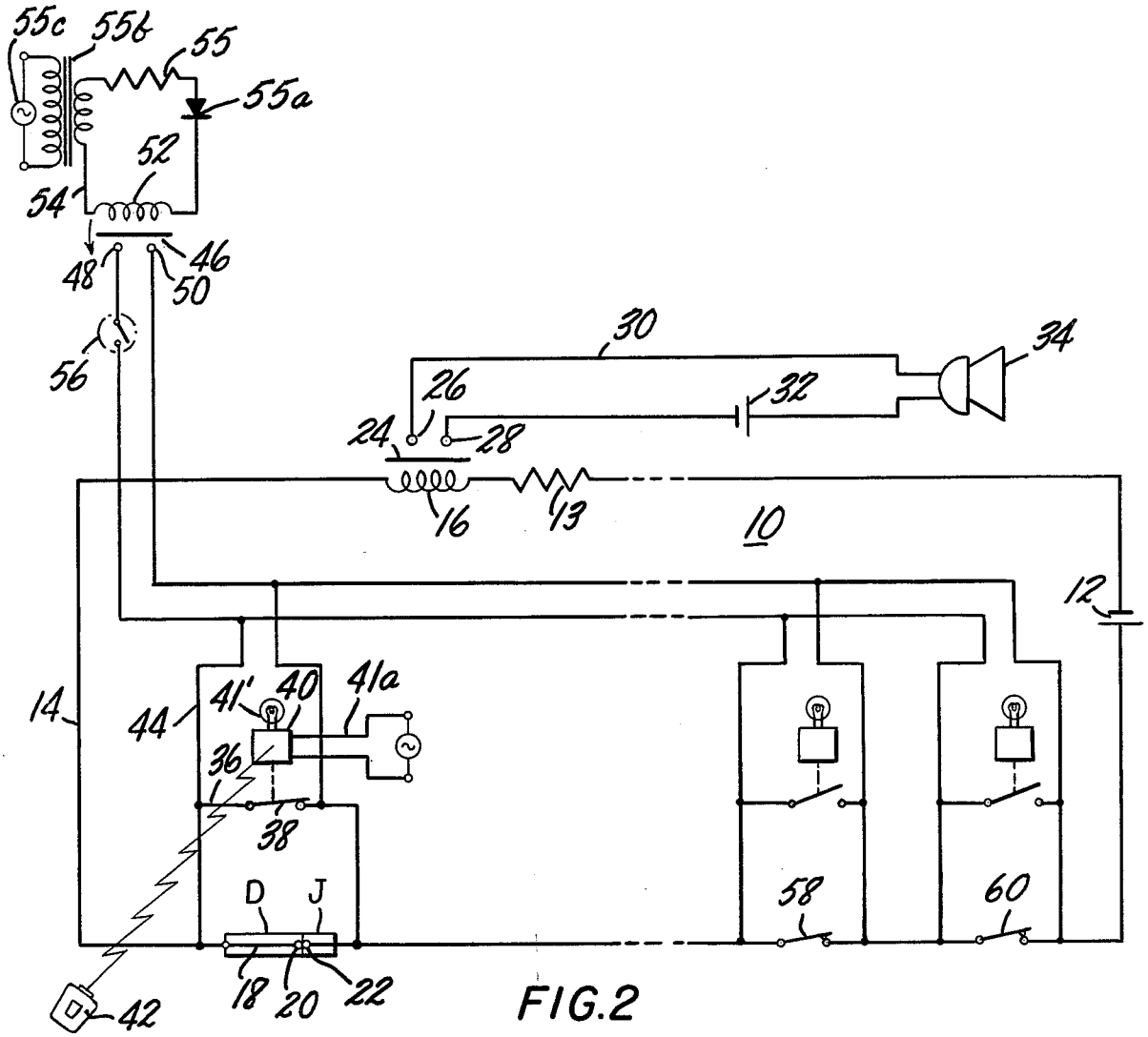
FIG. 2 is a schematic diagram of another preferred embodiment of the invention.

Alternatively, the receiver-driver 40 may derive its power from house current, as illustrated by leads **41*a* (FIG. 2). In this case, a second shunt 44 is placed in parallel with the first shunt so that the door D can be opened in case of a power failure without setting off an alarm (bearing in mind that the first shunt would be rendered inoperative by failure of a.c. power, since the switch 38 would remain open). The second shunt is normally open, since the movable contact of a third switch 46 is normally held away from fixed contacts 48, 50 by a coil 52 in the circuit 54, which also contains a current-limiting resistor 55 and a diode or other rectifier 55*a*. The circuit 54 derives its power from a transformer 55*b*, which can be of the step-down type, the primary side of the transformer 55*b* being connected to the source 55*c*** of house current. In the U.S., house current is normally 110 or 220 volts at 60 Hertz.

If the house current fails, the movable contact of the third switch 46 is spring-biased to close with the contacts 48, 50 so that the second shunt is armed. The second shunt is finally completed, however, only by operation of a key, intended to be carried by authorized persons, to close a lock-actuated switch 56. The third and lock-actuated switches 46, 56 are in series with each other and collectively in parallel with the first and second switches 18, 38. Accordingly, upon failure of the a.c. power, it is possible to gain entry to the protected space without setting off an alarm only if one has a key and knows the location of the lock, which may be concealed. Otherwise, opening the door 18 will set off the alarm. The switch 56 may be actuated by a double-cylinder lock (not illustrated) which is mounted in a door, for example, and accessible from both inside and outside the apartment or other space to be protected.

Signal means such as a lamp 41' is preferably provided in a series circuit in the receiver-driver 40 so that the lamp lights upon reception by the receiver-driver 40 of the control signal. This provides a simple check of the operativeness of the system, including the batteries used therein.

A number of doors, windows and other openable means can be protected in the same manner, as indicated at 58, 60. Associated with each door or window, etc., is circuitry similar to that described above.

Thus there is provided in accordance with the invention a novel and highly-effective security system for giving an alarm when unauthorized persons gain access to a protected space by opening openable means such as a door or window, and for permitting access to the protected space by authorized persons without giving an alarm. Among the many advantages of the systems, the following are especially noteworthy:

The system is especially designed for use in the average small city apartment, particularly for protection against burglars.

The system utilizes simple, conventional components of low cost which are readily available.

The small transmitter can conveniently be carried on the person of an authorized individual, for example in a pocket or purse.

While a decal warning that the premises are protected may be used in cases where such warning is deemed appropriate, the decal may be dispensed with and the very existence of the system can be kept secret even when the system is used by authorized pesons in the presence of others.

The system is independent of the operation of a lock, except for the backup provided in case of power failure (FIG. 2).

The several transmitters used by different households in the same apartment building may employ the same transmission frequencies or coding. They will not interfere with one another, in terms of setting off an alarm. Moreover, the activation of a receiver-driver in another apartment within range of the transmitter is temporary and too short for practical purposes to allow unauthorized entry into such other apartment. On the other hand, different points of entry may be selectively protected by means of different codes. For example, each apartment can have its own secret code so that there is not even a theoretical possibility of interference.

There is no way in which a burglar can test out the secret code without a high risk of setting off the alarm. The only way for the burglar to ascertain whether the system has been deactivated is to interrupt the circuit. This will cause the alarm to go off, if the burglar has not properly deactivated it.

Whether authorized persons are on or off the premises, the premises are protected, and authorized entry and exit can be made, without the need to touch the system physically. Continuous protection is provided except (and this only in the case of non-selective deactivation in a multi-unit apartment, etc.) for the short time required for opening and closing the door for entry or exit (the time required for unlocking or locking the door is immaterial).

The transmitter may be actuated by a push button, which may be pressed for an indefinite time period, allowing always enough time for entry or exit but not more time than is actually needed. This is a distinct advantage as compared to systems employing preset timers, which must allow enough time for the slowest users and which, even so, may occasionally suffer false alarms because of the unwonted slowness of certain users at certain times.

The system adds no possibility of a false alarm to that existing in a conventional system lacking the deactivation feature, except the possibility of a failure of the transmitter or receiver-driver. However, it is possible to check for such failure by observing the test light 41'. It should normally be sufficient for the test light to be visible only inside the apartment or other protected space, but it can optionally be mounted so that it is visible outside the apartment or other protected space, or it can be supplemented with another light (not illustrated) which is so mounted.

Many other embodiments within the spirit and scope of the invention will readily occur to those skilled in the art upon a consideration of this disclosure. For example, the system as illustrated employs a particular arrangement of switches such that an alarm is set off when the circuit 10 is broken. That is, the condition of the circuit 10 to which the alarm responds is an interruption thereof. By rearranging the switches, it is possible in another embodiment of the invention (not illustrated) to cause the alarm to be set off when the circuit 10 is closed. That is, the condition of the circuit 10 to which the alarm responds is a completion thereof. This requires, for example, that the door or other openable means hold associated contacts apart when it is closed and allow them to come together when it is open. In this case, the switch 38 controlled by the receiver-driver 40 would be in series with the door-actuated switch 18 and would be normally closed but opened upon transmission of a proper control signal by the transmitter 42. Accordingly, the invention is to be construed as including all of the embodiments thereof within the scope of the appended claims.

I claim:

1. A security system for giving an alarm upon each occurrence when unauthorized persons gain access to a protected space by opening openable means such as a door or window and for permitting access to said protected space by authorized persons without revealing the presence of the security system, comprising:

circuit means operatively associated with said openable means, voltage means for applying a voltage to said circuit means, alarm means operatively associated with said circuit means for giving an alarm in response to a given condition of said circuit means, first switch means in said circuit means the condition of which changes when said openable means is opened, portable transmitter means concealable on the person of an authorized user of the system and controllable by such user for transmitting a control signal, receiver-driver means for receiving said control signal, and two-position switch means in said circuit means movable back and forth between said two positions by said receiver-driver means in response to reception or nonreception of said control signal so long as said receiver-driver means is operative, the position of said two-position switch means when said openable means is open then determining the condition of said circuit means and hence whether said alarm means is actuated.

2. A security system according to claim 1 wherein said first and two-position switch means comprise first and second make-break switches, respectively, in parallel with each other, said first switch being closed when said openable means is closed and open when said openable means is open and said two-position switch being normally open and being closed by said receiver-driver means in response to reception by said receiver-driver means of said control signal, and wherein said alarm is given when both of said switches are open.

3. A security system according to claim 1 wherein said receiver-driver means comprises self-contained battery means by which it is powered.

4. A security system according to claim 1 wherein said control signal is coded to reduce the likelihood of a false response by said receiver-driver means to spurious signals.

5. A security system according to claim 1 further comprising signal means operatively associated with said receiver-driver means and responsive to reception of said control signal by said receiver-driver means for indicating whether said system is operative.

6. A security system for giving an alarm when unauthorized persons gain access to a protected space by opening openable means such as a door or window and for permitting access to said protected space by authorized persons without giving said alarm, comprising:

circuit means operatively associated with said openable means, voltage means for applying a voltage to said circuit means, alarm means operatively associated with said circuit means for giving an alarm in response to a given condition of said circuit means, first switch means in said circuit means the condition of which changes when said openable means is opened, transmitter means controllable by authorized persons for transmitting a control signal, receiver-driver means powered by house current for receiving said control signal, second switch means in said circuit means the condition of which is controllable by said receiver-driver means in response to reception of said control signal so long as said receiver-driver means is operative, the condition of said second switch means when said openable means is open then determining the condition of said circuit means and hence whether said alarm means is actuated, and third switch means in said circuit means the condition of which is controlled by the presence or absence of said house current and lock-actuated switch means in said circuit means the condition of which is controllable by authorized persons, whereby, when said house current fails, thereby rendering said receiver-driver means inoperative, the conditions of said third and lock-actuated switch means determine the condition of said circuit means when said openable means is open and hence whether said alarm means is actuated.

7. A security system according to claim 6 wherein said first and second switch means comprise first and second make-break switches, respectively, in parallel with each other, said first switch being closed when said openable means is closed and open when said openable means is open and said second switch being normally open and being closed by said receiver-driver means in response to reception by said receiver-driver means of said control signal, and wherein said third and lock-actuated switch means comprise third and lock-actuated make-break switches, respectively, in series with each other and collectively in parallel with said first and second switches, said third switch being open when said house current is present and closed when said house current is absent and said lock-actuated switch being normally open and being closable by authorized persons, and wherein said alarm is given when and only when said first and second switches and at least one of said third and lock-actuated switches are open.

* * * * *